US008555999B2

(12) United States Patent
McRoberts et al.

(10) Patent No.: US 8,555,999 B2
(45) Date of Patent: Oct. 15, 2013

(54) TWIST-HANDLED POWER TOOL WITH LOCKING SYSTEM

(75) Inventors: Jason C. McRoberts, Red Lion, PA (US); Ashok S. Baskar, Lutherville, MD (US); David Miller, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 418 days.

(21) Appl. No.: 12/783,850

(22) Filed: May 20, 2010

(65) Prior Publication Data

US 2011/0266014 A1 Nov. 3, 2011

Related U.S. Application Data

(60) Provisional application No. 61/330,076, filed on Apr. 30, 2010.

(51) Int. Cl.
*B25B 23/00* (2006.01)

(52) U.S. Cl.
USPC ..... 173/217; 173/170; 173/216

(58) Field of Classification Search
USPC ..... 173/216–217, 42, 45, 47, 29, 170; 310/50; 81/177.8, 177.85, 180.1
See application file for complete search history.

(56) References Cited

U.S. PATENT DOCUMENTS

| | | | | |
|---|---|---|---|---|
| 597,469 | A | 1/1898 | Marshall | |
| 2,542,038 | A | 2/1951 | Lewis | |
| 4,198,558 | A * | 4/1980 | Benty | 392/384 |
| 4,759,240 | A | 7/1988 | Lin | |
| D305,975 | S | 2/1990 | Emmerling | |
| 4,977,306 | A * | 12/1990 | Kosaka et al. | 392/380 |
| 5,372,420 | A * | 12/1994 | Van Deursen et al. | 366/129 |
| 6,039,126 | A * | 3/2000 | Hsieh | 173/216 |
| D441,267 | S | 5/2001 | Heun | |
| 6,308,599 | B1 * | 10/2001 | Fu-Hui | 81/490 |
| 6,928,902 | B1 * | 8/2005 | Eyssallenne | 81/57.26 |
| 7,185,998 | B2 | 3/2007 | Oomori et al. | |
| 7,434,496 | B2 * | 10/2008 | Hu | 81/177.7 |
| 7,481,135 | B2 * | 1/2009 | Schoenbeck et al. | 81/177.7 |
| 7,508,679 | B2 * | 3/2009 | Roehm | 361/755 |
| 7,557,534 | B2 * | 7/2009 | Uehlein-Proctor et al. | 320/112 |
| 7,649,337 | B2 * | 1/2010 | Uehlein-Proctor et al. | 320/112 |
| 7,779,931 | B2 * | 8/2010 | Townsan | 173/216 |
| 7,932,695 | B2 * | 4/2011 | Uehlein-Proctor et al. | 320/113 |
| 8,322,456 | B2 * | 12/2012 | Pozgay et al. | 173/1 |
| 2005/0247466 | A1 * | 11/2005 | Andriolo et al. | 173/170 |
| 2006/0053762 | A1 * | 3/2006 | Stover et al. | 56/16.7 |

(Continued)

OTHER PUBLICATIONS

Skil 2348 Twist Handle Screwdriver Manual dated Aug. 7, 2007

*Primary Examiner* — Robert Long
(74) *Attorney, Agent, or Firm* — Harness, Dickey & Pierce, P.L.C.

(57) ABSTRACT

A power tool with first and second housing portions, a powertrain, a mounting hub and a lock bar. The powertrain has an output member that extends from the second housing portion and which is movable relative to an output member axis. The mounting hub is fixedly coupled to one of the first and second housing portions. The lock bar is movably mounted to the other one of the first and second housing portions between a locked position and a first unlocked position. The lock bar cooperates with the mounting hub in the locked position to inhibit relative rotation between the first and second housing portions. Placement of the lock bar in the first unlocked position permits relative rotation between the first and second housing portions.

20 Claims, 9 Drawing Sheets

(56) References Cited

U.S. PATENT DOCUMENTS

2006/0096770 A1* 5/2006 Roberts ..... 173/217
2007/0039301 A1* 2/2007 Velke et al. ..... 56/10.8
2008/0121074 A1* 5/2008 Hu ..... 81/177.8
2009/0102420 A1* 4/2009 Uehlein-Proctor et al. .. 320/114
2010/0163265 A1* 7/2010 Hozumi et al. ..... 173/217
2010/0263896 A1* 10/2010 Brennenstuhl et al. ..... 173/217
2011/0203821 A1* 8/2011 Puzio et al. ..... 173/1
2012/0048071 A1* 3/2012 Huang ..... 81/177.8
2012/0160529 A1* 6/2012 Eshleman et al. ..... 173/1

* cited by examiner

TWIST-HANDLED POWER TOOL WITH LOCKING SYSTEM

FIELD

The present disclosure relates to a twist-handled power tool with a locking system.

BACKGROUND

A twist-handled power tool is disclosed in U.S. Pat. No. 5,372,420, the disclosure of which is hereby incorporated by reference as if fully set forth in detail herein. Such power tools typically include a first housing member, which can be employed as a handle, and a second housing member into which an output member of the power tool is housed. The first housing portion may be pivoted relative to the second housing member between a first position and a second position. In the first position, which is referred herein as being the "inline grip position", the first and second housing portions are aligned to one another such that the longitudinal axis of the tool is arranged about a common line, with the common line being coincident to the rotational axis of the output member. In the second position, which is referred to herein as being the "pistol grip position", the longitudinal axis of the first housing member intersects the longitudinal axis of the second housing member at a point (i.e., the axes are transverse to one another).

While such power tools are suited for their intended purpose, there remains a need in the art for an improved twist-handled power tool.

SUMMARY

This section provides a general summary of the disclosure, and is not a comprehensive disclosure of its full scope or all of its features.

In one form the teachings of the present disclosure provide a power tool with first and second housing portions, a powertrain, a mounting hub and a lock bar. The powertrain has an output member that extends from the second housing portion and which is movable relative to an output member axis. The mounting hub is fixedly coupled to one of the first and second housing portions. The lock bar is slidably mounted to the other one of the first and second housing portions for movement in a direction that is transverse to a longitudinal axis of the other one of the first and second housing portions between a locked position and a first unlocked position. The lock bar cooperates with the mounting hub in the locked position to inhibit relative rotation between the first and second housing portions. Placement of the lock bar in the first unlocked position permits relative rotation between the first and second housing portions.

In yet another form the teachings of the present disclosure provide a power tool having first and second housing portions, a power train, a mounting hub, a bar body, a pair of lock tabs and a pair of lock tab recesses. The powertrain has an output member that extends from the second housing portion and which is movable relative to an output member axis. The mounting hub is fixedly coupled to one of the first and second housing portions. The bar body is movably mounted to the other one of the first and second housing portions. The lock tabs are fixedly coupled to one of the bar body and the mounting hub. The lock tab recesses are defined by the other one of the bar body and the mounting hub. The bar body is movable between a first position and a second position. Placement of the bar body in the first position locates the lock tabs in the lock tab recesses to inhibit relative rotation between the first and second housing portions. Placement of the bar body in the second position locates the lock tabs out of alignment with the lock tab recesses to permit relative rotation between the first and second housing portions.

In still another form the teachings of the present disclosure provide a power tool with a first housing portion, a battery, a second housing portion, a powertrain, a mounting hub and a lock bar assembly. The first housing portion defines a handle. The battery is received into the first housing portion. The powertrain is received in the second housing portion and has a motor, a transmission and an output member. The output member extends from the second housing portion and is rotatable about an output member axis. The mounting hub is fixedly coupled to the second housing portion and includes a pair of annular segments that extend concentrically about a pivot axis and cooperate to define a pair of lock recesses. The mounting hub is mounted on the first housing portion to pivotally couple the first housing portion to the second housing portion for rotation about the pivot axis. The lock bar assembly includes a lock bar and a spring. The lock bar has a bar body, which is slidably mounted to the first housing portion, a pair of lock tabs and a pocket into which the spring is received. The lock bar is movable between a first unlocked position, a locked position and a second unlocked position. Each of the first and second unlocked positions the lock tabs are disposed radially between the annular segments to permit the annular segments to pass between the lock tabs. The lock tabs are disposed in-line with the annular segments when the lock bar is in the locked position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
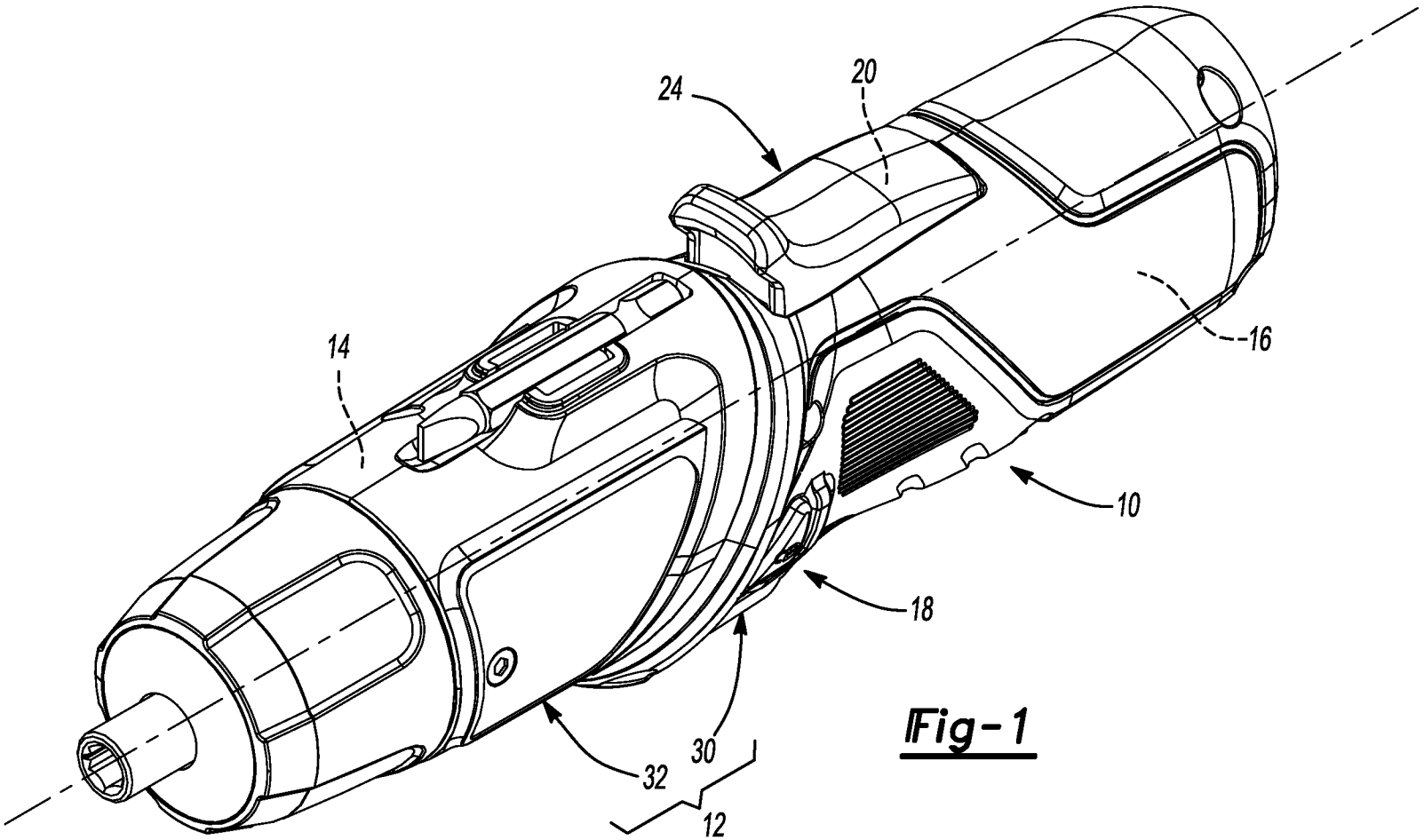
FIG. 1 is a perspective view of an exemplary twist-handled power tool constructed in accordance with the teachings of the present disclosure, the power tool being illustrated with a handle that is disposed in an inline grip position.
Figure 12:
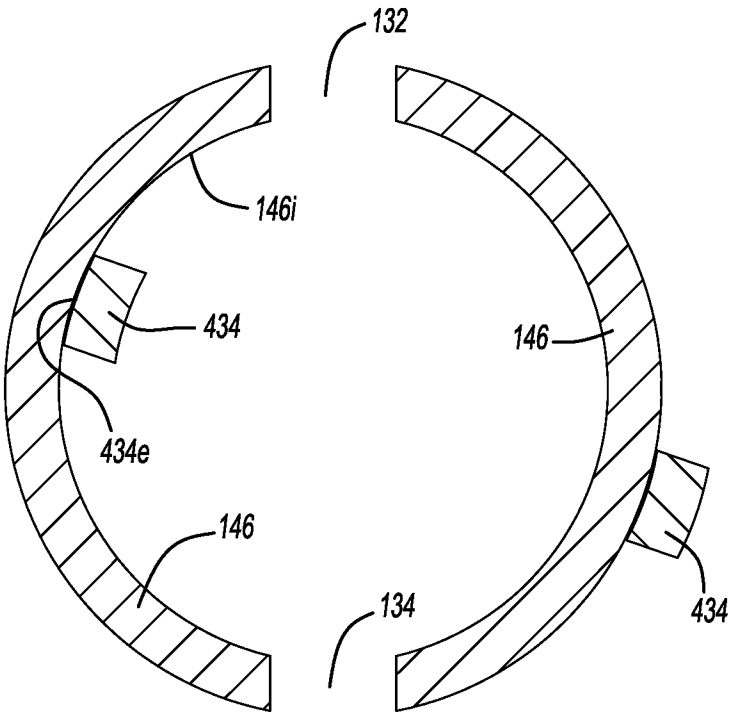
Figure 11:
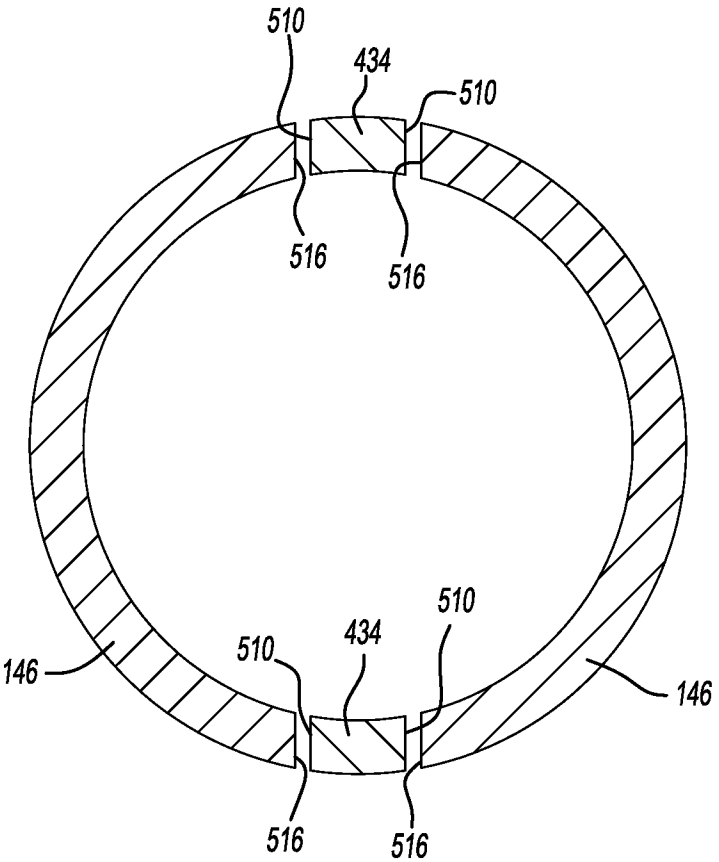

FIG. 11 is a section view of a portion of the tool of FIG. 1 illustrating the a portion of the lock bar assembly relative to a portion of the mounting hub when the handle in the in-line grip position or the pistol-grip position; and FIG. 12 is a section view similar to that of FIG. 11 but depicting the portion of the lock bar assembly relative to the portion of the mounting hub when the handle is in a position that is between the in-line grip position and the pistol-grip position.

Corresponding reference numerals indicate corresponding parts throughout the several views of the drawings.

DETAILED DESCRIPTION

Figure 2:
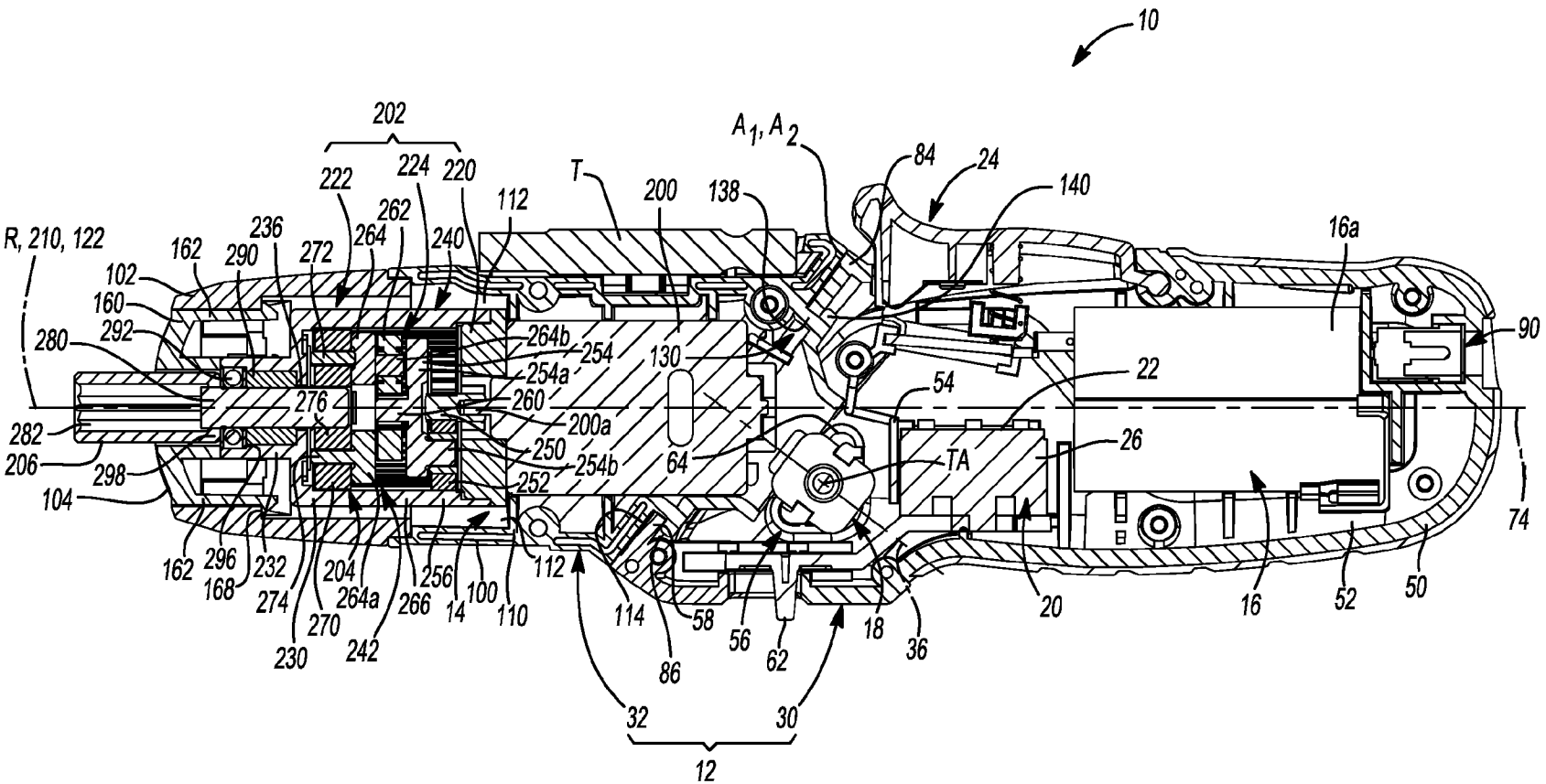
FIG. 2 is a longitudinal section view of the power tool of FIG. 1.

With reference to FIGS. 1 and 2 of the drawings, an exemplary twist-handle power tool is generally indicated by reference numeral 10. The power tool 10 can include a housing assembly 12, a powertrain 14, a battery 16, a locking system 18, and a control unit 20 that can include a controller 22, a trigger switch 24 and a reversing switch 26. While the particular power tool illustrated in the drawings and described herein is a driver that is configured to provide a rotary output, it will be appreciated that the teachings of the present disclosure have application to other types of power tools, including tools that are configured to produce a reciprocating output (e.g., sander, reciprocating saw).

Figure 3:
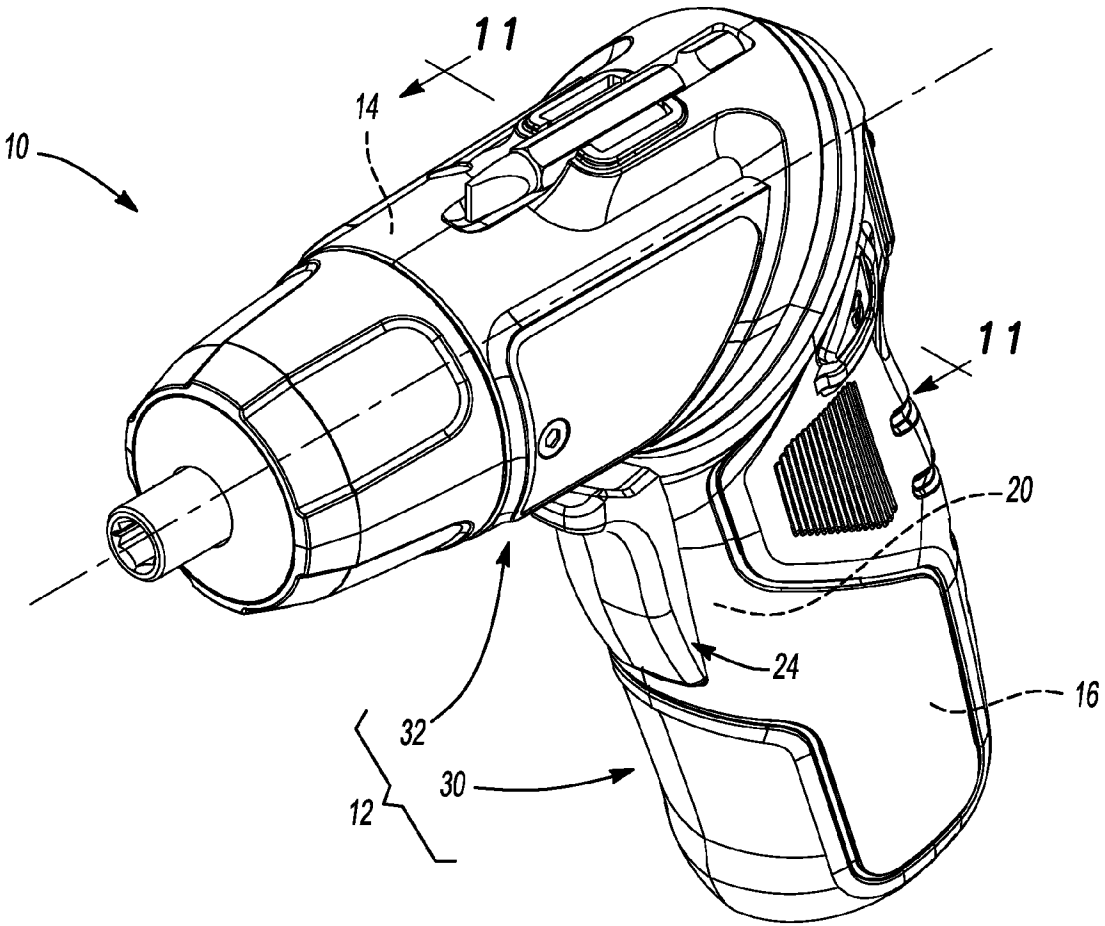
FIG. 3 is a perspective view of the power tool of FIG. 1 with the handle being disposed in a pistol grip position.

The housing assembly 12 can include a first housing portion 30 and a second housing portion 32. The first housing portion 30 can define a handle of the powertool 10 and can be mounted to the second housing portion 32 for rotation about a rotational axis 36 between a first position (i.e., an inline grip position), which is shown in FIG. 1, and a second position (i.e., a pistol grip position) that is shown in FIG. 3.

Figure 4:
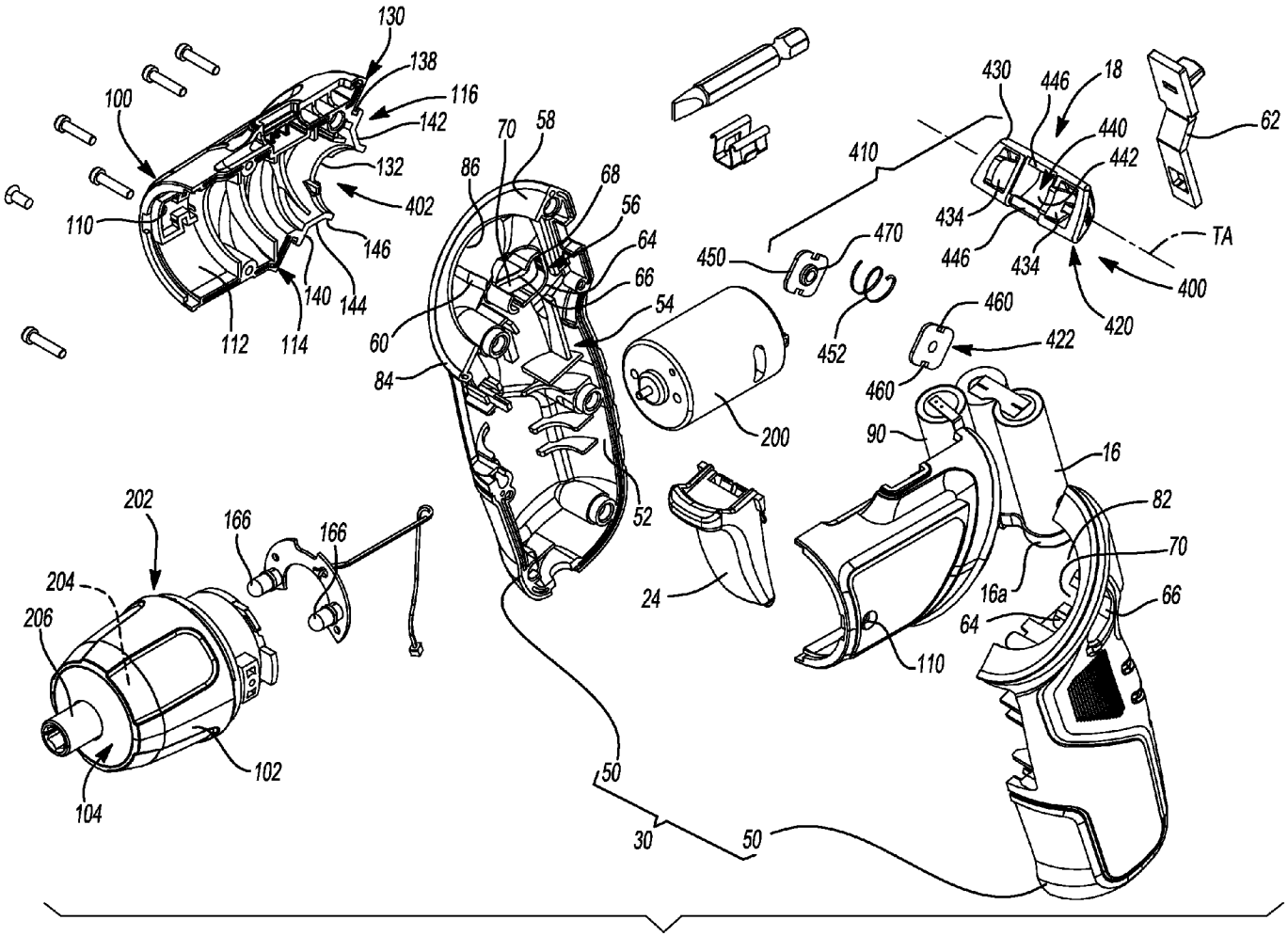
FIG. 4 is an exploded perspective view of a portion of the power tool of FIG. 1.

With reference to FIGS. 2 and 4, the first housing portion 30 can be formed of a pair of first housing shells 50 that can cooperate to define an internal cavity 52, a controller mount 54, a lock bar mount 56, a first inclined wall 58 and one or more first stop members 60. The internal cavity 52 can be configured to receive the battery 16, which can conventionally comprise one or more battery cells 16*a*. The controller mount 54 can be configured to receive the control unit 20 such that the controller 22 is fixedly mounted within the first housing portion 30, the trigger switch 24 is pivotally coupled to the first housing portion 30 and a reversing lever 62 associated with the reversing switch 26 is supported for sliding movement relative to the first housing portion 30. The lock bar mount 56 can comprise a pair of rib structures 64, with each of the rib structures 64 being formed on a corresponding one of the first housing shells 50. Each rib structure 64 can be disposed partly or completely about a perimeter of a lock bar aperture 66 formed through an associated one of the first housing shells 50. In the example provided, each rib structure 64 defines an abutment surface 68, which can be disposed at a first predetermined distance from a rotational axis 36 and a recess 70 that extends away from the rotational axis 36 by a second predetermined distance that is greater than the first predetermined distance. The first inclined wall 58 can be transverse to a longitudinal axis 74 of the first housing portion 30 and perpendicular to the rotational axis 36 and in the particular example provided, the first inclined wall 58 is disposed at a 45 degree angle to the longitudinal axis 74 of the first housing portion 30. The first inclined wall 58 can define a central aperture 82 and a raised rim member 84 that forms a first abutment surface that is configured to contact the second housing portion 32 as will be explained in more detail below. An annular slot 86 can be formed in the first housing portion 30 between the first inclined wall 58 and the lock bar mount 56. In the example provided, a first stop member 60 is provided on each of the first housing shells 50 between the annular slot 86 and the lock bar mount 56 and generally in-line with the recess 70 in the rib structure 64.

In the particular example provided, the battery 16 is received into internal cavity 52 and is not removed from the first housing portion 30 when it is recharged. Accordingly, charging terminals 90 can be mounted to the first housing portion 30 and electrically coupled to the battery 16 to facilitate the recharging of the battery 16 in a known manner (e.g., through contact of the charging terminals 90 with corresponding terminals (not shown) of a charging cradle or a charging cable).

Figure 5:
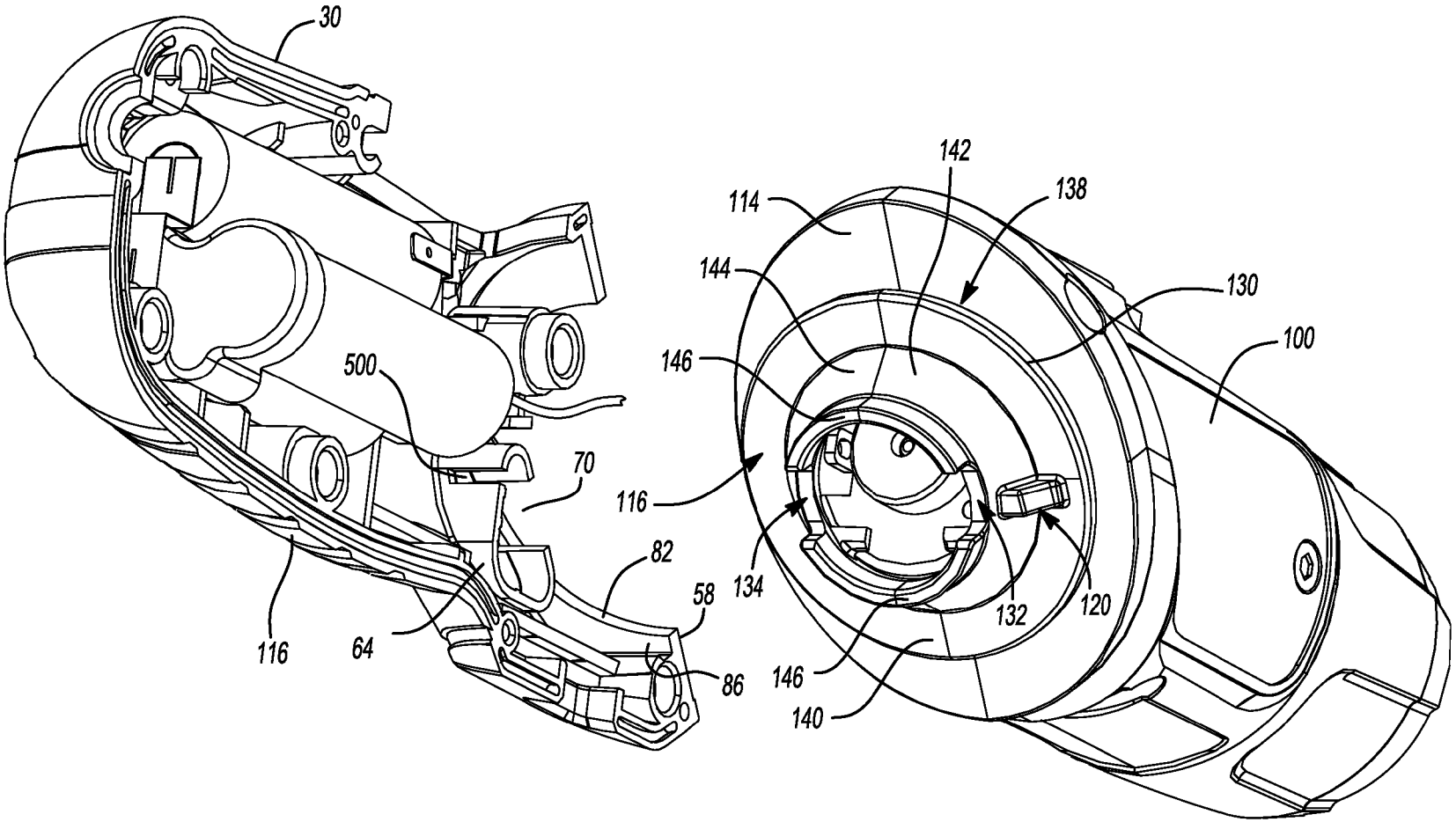
FIG. 5 is an exploded perspective view of a portion of the power tool of FIG. 1, illustrating the interface between the first and second housing portions in more detail.

With reference to FIGS. 2, 4 and 5, the second housing portion 32 can comprise a housing shell assembly 100, a nose cover 102 and a lens structure 104. The housing shell assembly 100 can be formed of a pair of second housing shells 110 that can cooperate to define an internal cavity 112, a second inclined wall 114, a mounting hub 116 and one or more second stop members 120. The internal cavity 112 can be configured to house at least a portion of the powertrain 14. The second inclined wall 114, which can be disposed on a proximal end of the housing shell assembly 100, can be disposed transverse to a longitudinal axis 122 of the second housing portion 32 and perpendicular to the rotational axis 36 and in the particular example provided, the second inclined wall 114 is disposed at a 45 degree angle to the longitudinal axis 122 of the second housing portion 32. The second inclined wall 114 can define a second abutment surface that can abut the first abutment surface, which is formed by the raised rim member 84 on the first inclined wall 58. Abutment of the first and second abutment surfaces is indicated at (A1, A2) in FIG. 2. The mounting hub 116 can extend from the second inclined wall 114 toward the first housing portion 30 and can include a hub structure 130 and first and second hub recesses 132 and 134, respectively. The hub structure 130 can comprise an annular hub 138, which can be disposed concentrically about the rotational axis 36 and generally perpendicular to the second inclined wall 114, and a flange member 140 that can extend radially outwardly from the annular hub 138. The annular hub 138 is sized to be received in a slip fit manner into the central aperture 82 to permit the first housing portion 30 to rotate about the rotational axis 36 relative to the mounting hub 116 (and thus the second housing portion 32). The flange member 140, which can be received in the annular slot 86, can be spaced apart from the second inclined wall 114 by a distance that permits free rotation of the first housing portion 30 relative to the mounting hub 116 but which controls side play (i.e., pivoting of the first housing portion 30 relative to the second inclined wall 114) by a desired degree. In the example provided, a side of the flange member 140 that faces the second inclined wall 114 is formed parallel to the second inclined wall 114 and abuts a side of the first inclined wall 58 opposite the second inclined wall 114. The first and second hub recesses 132 and 134 can be formed in the mounting hub 116 at a location proximate the recesses 70 in the rib structure 64 when the housing shell assembly 100 is mounted to the first housing portion 30. In the particular example provided, a wall member 142 extends from the flange member 140 in a direction away from the second inclined wall 114 and includes a frustoconical portion 144 and a pair of annular segments 146, each of which forming a corresponding one of the first and second hub recesses 132 and 134. The annular segments 146 can be disposed concentrically about the rotational axis 36. The second stop member(s) 120 can be coupled to the mounting hub 116 and can cooperate with the first stop member(s) 60 to limit rotation of the first housing portion 30 about the rotational axis 36 relative to the second housing portion 32. In the example provided, a single second stop member 120 is employed and cooperates with the first stop members 60 to align the first and second hub recesses 132 and 134 to the recesses 70 in the rib structure 64 when the first housing portion 30 is placed in the first and second positions.

More specifically, contact between the second stop member 120 and the first stop member 60 on a first one of the first housing shells 50 will align the first and second hub recesses 132 and 134 to the recess 70 in the rib structure 64 when the first housing portion 30 is in the first position, and contact between the second stop member 120 and the first stop member on the other one of the first housing shells 50 will align the first and second hub recesses 132 and 134 to the recess 70 in the rib structure 64 when the first housing portion 30 is in the second position.

With reference to FIGS. 2 and 4, the nose cover 102 can be coupled to the distal end of the housing shell assembly 100 (i.e., the end opposite the second inclined wall 114) and can effectively extend the internal cavity 112, as well as clamp around the distal end of the housing shell assembly 100 to help prevent separation of the second housing shells 110. While the particular example depicted in the drawings illustrates a nose cover 102 that is discrete and separate from the second housing shells 110 that form the housing shell assembly 100, it will be appreciated that the nose cover 102 could be integrally formed with the housing shell assembly 100 in the alternative.

The lens structure 104 can be formed of a suitable plastic material, such as a clear plastic, and can be received into an end of the nose cover 102 opposite the housing shell assembly 100. The lens structure 104 can define a lens 160 and a plurality of engagement arms 162. The lens 160 can be configured to collect light from a light source received in the nose cover 102, such as a pair of LED lamps 166 which can be electrically coupled to the control unit 20 and the battery 16, and to diffuse the collected light in a desired manner. The engagement arms 162 can extend rearwardly from the lens 160 and can be secured to an annular ridge or rim 168 formed in the nose cover 102. It will be appreciated that the engagement arms 162 can be received into corresponding longitudinally extending grooves (not specifically shown) in the nose cover 102 to thereby inhibit rotation of the lens structure 104 relative to the nose cover 102. It will also be appreciated that the engagement arms 162 can be resiliently deflectable relative to the lens 160 so as to deflect in a radially inward direction as the lens structure 104 is inserted into the nose cover 102 and prior to engagement of the engagement arms 162 with the annular rim 168. If desired, a reflector (not specifically shown) can be mounted in the nose cover 102 rearwardly of the light source to reflect light forwardly through the lens 160.

The powertrain 14 can include a motor 200, a transmission assembly 202, a spindle lock 204 and an output member 206.

The motor 200 can be an electric motor that can be electrically coupled to the battery 16 and the trigger switch 24. The motor 200 can be mounted in the interior cavity 112 of the housing shell assembly 100 such that a rotational axis 210 of the output shaft 200*a* of the motor 200 is disposed about (i.e., concentrically with) the longitudinal axis 122 of the second housing portion 32.

The transmission assembly 202 can include a mounting plate 220, which can be mounted to the motor 200, a gear case housing 222 and a transmission 224. The gear case housing 222 can include a cup-like gear case 230 and a spindle mount 232. The gear case 230 can be mounted to the mounting plate 220 to thereby fixedly couple the motor 200 and the gear case housing 222 to one another. The spindle mount 232 can be an annular structure that can extend axially away from the gear case 230 on a side opposite the motor 200. An output member aperture 236 can extend through the gear case 230 and the spindle mount 232.

The transmission 224 can be received in the gear case 230 and can transmit rotary power between the output shaft 200*a* of the motor 200 and the output member 206. In the particular example provided, the transmission 224 is a two-stage, single speed planetary transmission with a first planetary stage 240 and a second planetary stage 242, but it will be appreciated that any suitable transmission, including a multi-speed transmission, could be employed in the alternative. The first planetary stage 240 can include a first sun gear 250, a plurality of first planet gears 252, a first planet carrier 254 and a first ring gear 256. The first sun gear 250 can be coupled to the output shaft 200*a* of the motor 200 for rotation therewith and can be meshingly engaged with the first planet gears 252. The first planet carrier 254 can include a carrier body 254*a* and a plurality of pins 254*b* that can be fixedly coupled to the carrier body 254*a*. Each of the first planet gears 252 can be mounted for rotation on a corresponding one of the pins 254*b*. The first ring gear 256 can be meshingly engaged with the first planet gears 252. In the example provided, the first ring gear 256 is integrally formed with the gear case 230.

The second planetary stage 242 can include a second sun gear 260, a plurality of second planet gears 262, a second planet carrier 264 and a second ring gear 266. The second sun gear 260 can be coupled to the carrier body 254*a* of the first planet carrier 254 for rotation therewith and can be meshingly engaged with the second planet gears 262. The second planet carrier 264 can include a carrier body 264*a* and a plurality of pins 264*b* that can be fixedly coupled to the carrier body 264*a*. Each of the second planet gears 262 can be mounted for rotation on a corresponding one of the pins 264*b*. The second ring gear 266 can be meshingly engaged with the second planet gears 262. In the example provided, the second ring gear 266 is integrally formed with the gear case 230.

The spindle lock 204 is conventional in its construction and operation and can comprise an outer collar 270, a plurality of lock pins 272, a plurality of projections 274, which can be integrally formed with the carrier body 264*a* of the second planet carrier 264, and an anvil 276. The outer collar 270 can be an annular structure that can be non-rotatably engaged to the gear case 230. The lock pins 272 can extend longitudinally parallel to the rotational axis R of the output member 206 between the projections 274 and an interior surface of the outer collar 270. The anvil 276 can be received in the gear case 230 within the projections 274 and in-line with the output member aperture 236.

The output member 206 can be received into the spindle mount 232 and through the output member aperture 236. In the particular example provided, the output member 206 includes a solid shaft portion 280 and a larger diameter hollow tool holder portion 282 having a hex-shaped aperture that is configured to drivingly engage a hex shaped bit or tool T. One or more bearings may be employed to support the output member 206 for rotation relative to the gear case housing 222 and/or to transmit thrust loads from the output member 206 to the gear case housing 222. For example, a journal bearing 290 could be mounted on the shaft portion 280 to support the output member 206 for rotation relative to the gear case housing 222 and a thrust bearing 292 can be received over the shaft portion 292 and abutted against a shoulder 296 in the spindle mount 232 and a shoulder 298 on the output member 206 to transmit axially directed thrust loads from the output member 206 to the gear case housing 222.

The shaft portion 280 of the output member 206 can be drivingly engaged to the anvil 276 in a manner that permits limited rotation of the output member 206 relative to the anvil 276. The anvil 276 is configured to cooperate with the lock pins 272 and the outer collar 270 to permit the anvil 276 to be rotated by the second planet carrier 264 to thereby drive the output member 206, but to lock (i.e., via contact between the anvil 276, the lock pins 272 and the outer collar 270) when a torsional input is provided through the output member 206 that would tend to back-drive the transmission 224.

Figure 6:
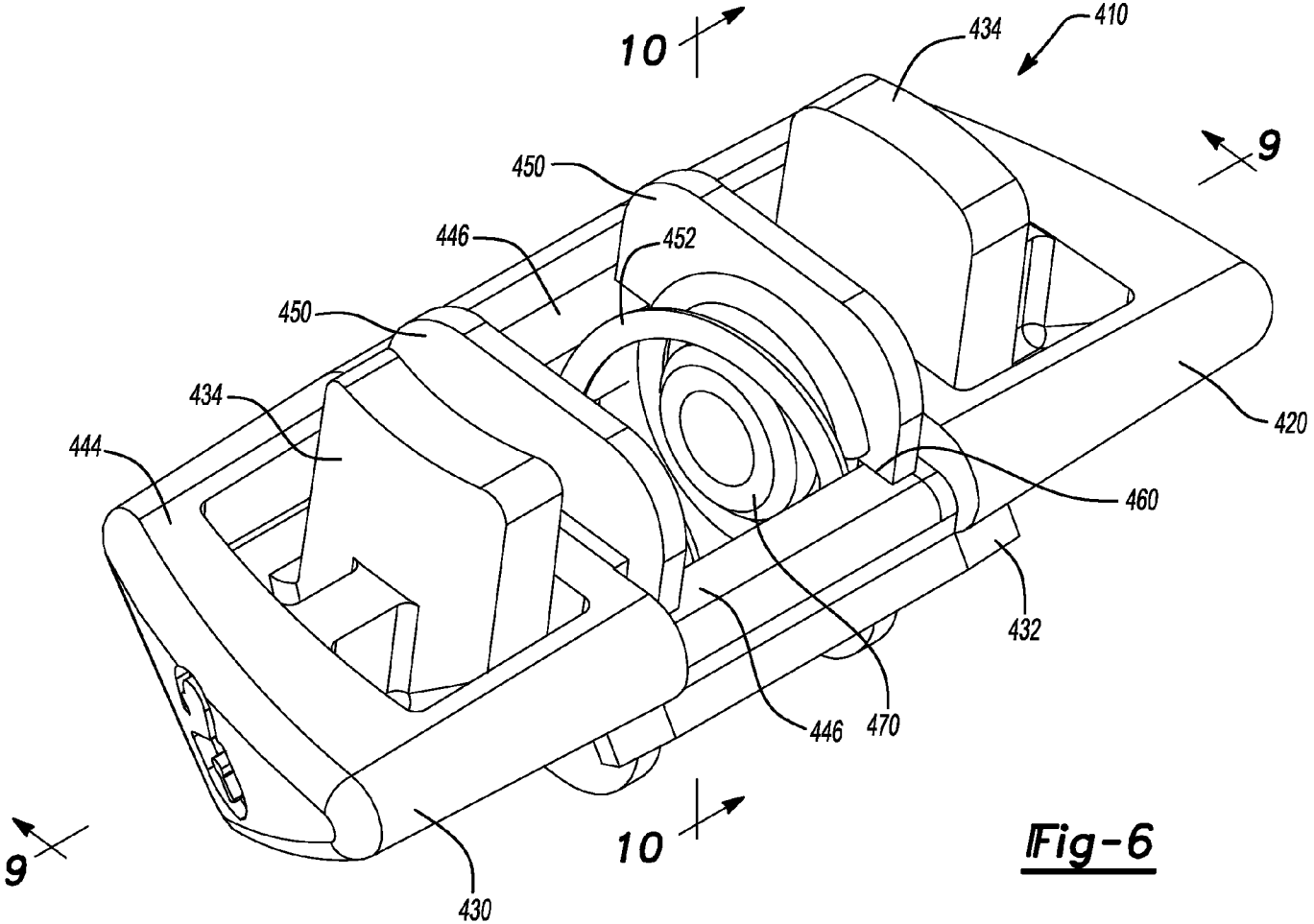
FIG. 6 is a perspective view of a portion of the power tool of FIG. 1, illustrating a lock bar assembly in more detail.
Figure 7:
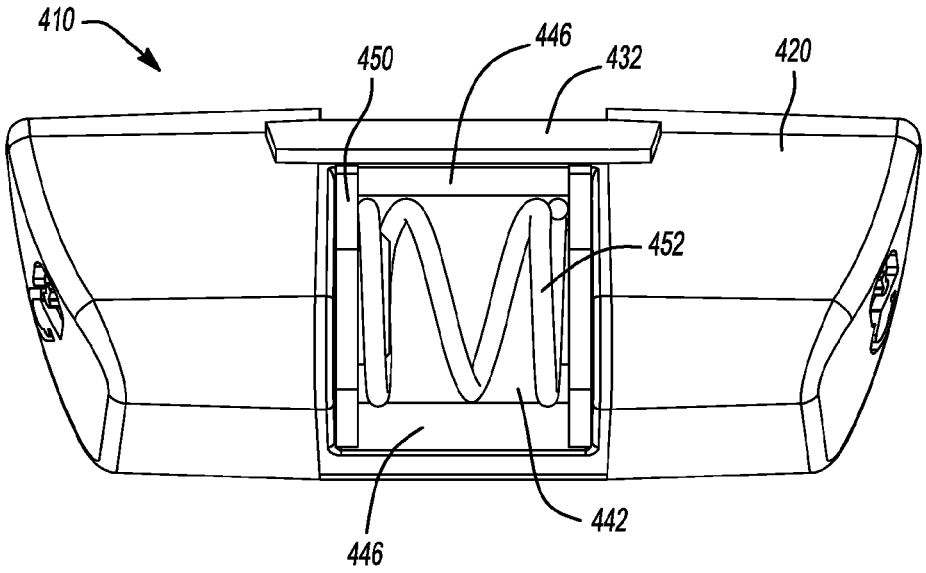
FIGS. 7 and 8 are bottom and side perspective views of the lock bar assembly of FIG. 6.
Figure 8:
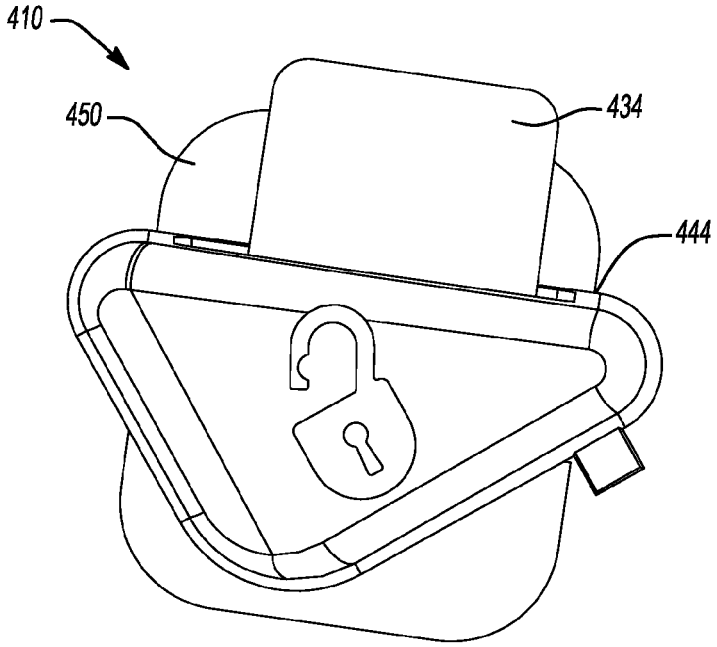
Figure 9:
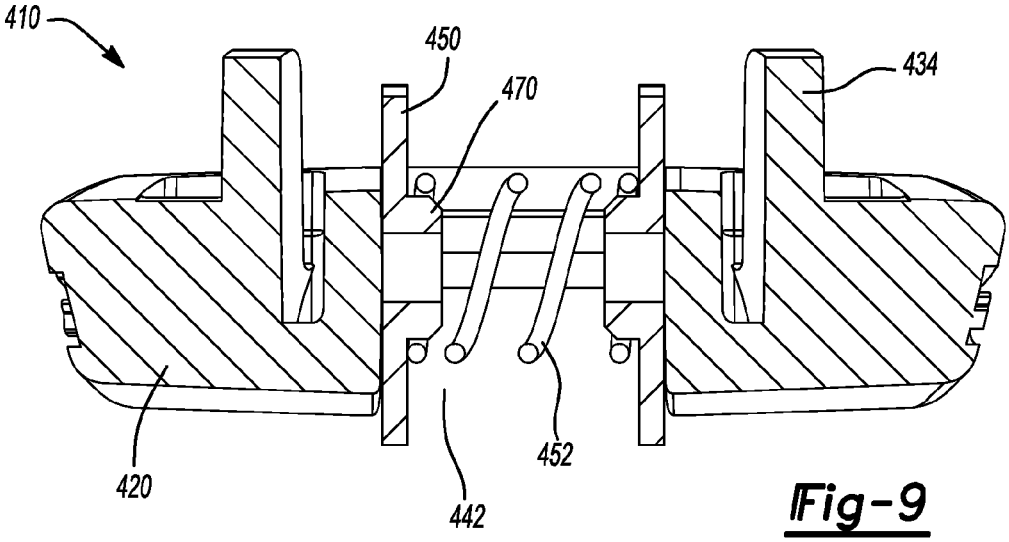
FIG. 9 is a section view taken along the line 9-9 of FIG. 6.
Figure 10:
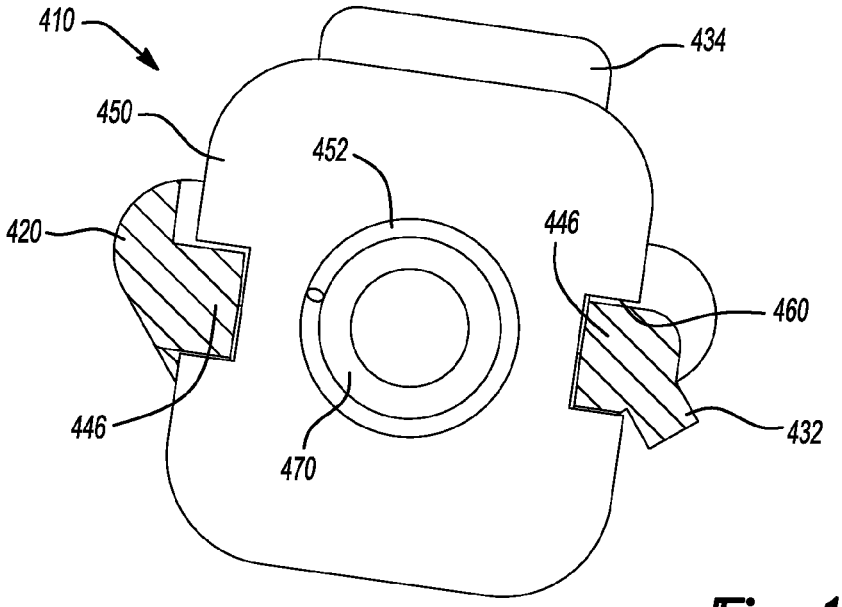
FIG. 10 is a section view taken along the line 10-10 of FIG. 6.

With reference to FIGS. 4 through 6, the locking system 18 can comprise a lock bar system 400, which can be mounted to one of the first and second housing portions 30 and 32, and a set of locking features 402 that are coupled to the other one of the first and second housing portions 30 and 32. In the particular example provided, the lock bar system 400 is associated with the first housing portion 30, while the set of locking features 402 is associated with the second housing portion 32. The lock bar system 400 can comprise the lock bar mount 56 and a lock bar assembly 410, which can be slidably received into the lock bar mount 56.

With reference to FIGS. 4 and 6-10, the lock bar assembly 410 can comprise a lock bar 420 and a biasing system 422. The lock bar 420 can comprise a bar body 430, a guide member 432 and a pair of locking tabs or stop members 434. The bar body 430 can be an elongate structure that can define a non-circularly shaped cross-section and a pocket 440 into which the biasing system 422 can be received. In the example provided, the bar body 430 defines a cross-section having a right-triangular shape in which the shorter sides are of a non-equal length. It will be appreciated that the lock bar apertures 66 and the rib structures 64 associated with the first housing portion 30 can be shaped in a complementary fashion. A person of ordinary skill in the art will appreciate that receipt of the bar body 430 (with its right-triangularly shaped cross section) into the complementary shaped lock bar apertures 66 effectively non-rotatably mounts the bar body 430 to the first housing portion 30. The pocket 440 can be tailored to the particular configuration of the biasing system 422 and in the particular example provided, includes a generally rectangular aperture 442, which extends through the bar body 430 generally perpendicular to the hypotenuse 444 of the right-triangular cross-sectional shape of the bar body 430, and a pair of guide rails 446 that extend generally parallel to the hypotenuse 444. The guide member 432 can be a rail-like structure that can be integrally formed with the bar body 430 and extend generally perpendicular from one of the sides of the right-triangularly shaped cross-section of the bar body 430. The stop members 434 can also be integrally formed with the bar body 430 and can comprise annular segments that are coupled to and extend outwardly from the bar body 430 generally perpendicular to the hypotenuse 444 of the right-triangular cross-sectional shape of the bar body 430. The stop members 434 can be disposed on opposite sides of the aperture 442 in the pocket 440.

The biasing system 422 can comprise a pair of plate members 450 and a spring 452. The plate members 450 can be shaped in a desired manner and can be received into the aperture 442 of the pocket 440 and engaged to the guide rails 446. In the particular example provided, the plate members 450 are generally rectangular in shape and include a pair of guide notches 460 that are complementary to the contour of the guide rails 446. The spring 452 can be received between the plate members 450 and can bias the plate members 450 away from one another and against the opposite sides of the pocket 440. If desired, one or both of the plate members 450 can be configured with a spring hub 470 that is configured to be received within the spring 452; the spring hub(s) 470 can be employed to aid in retaining the spring 452 to one or both of the plate members 450 and/or to limit the amount by which the spring 452 may be compressed (e.g., through contact with another structure, such as contact between two hubs 470).

The set of locking features 402 can be integrally formed with the housing shell assembly 100 of the second housing portion 32. In the particular example provided, the set of locking features 402 comprises the first and second hub recesses 132 and 134 that are formed in the mounting hub 116.

With reference to 2 and 4 through 6, when the lock bar assembly 410 is slidably received into the lock bar mount 56, the hypotenuse 444 of the cross-sectional shape of the lock bar 420 can be generally parallel to the first and second inclined walls 58 and 114 and generally perpendicular to the rotational axis 36; the guide member 432 on the lock bar 420 can be received into corresponding guide slots 500 (FIG. 5) formed in the rib structures 64 and one or both of the plate members 450 of the biasing system 422 can abutted against a corresponding ones of the abutment surfaces 68 formed on the rib structures 64. When the first housing portion 30 is in one of the first and second positions, the biasing system 422 can cooperate with both of the abutment surfaces 68 to orient (e.g., center) the lock bar 420 relative to the mounting hub 116 such that the stop members 434 are received into the first and second hub recesses 132 and 134 and rotationally inline with the annular segments 146 of the mounting hub 116 to thereby inhibit rotation of the first housing portion 30 relative to the second housing portion 32. With additional reference to FIG. 11, end faces 510 of the stop members 434 are positioned to contact end faces 516 of the annular segments 146 to limit or prevent rotational movement of the first housing portion 30 relative to the second housing portion 32 about the rotational axis 36.

With reference to FIGS. 2, 4 through 6 and 12, when a change in the position of the first housing portion 30 relative to the second housing portion 32 is desired, a force may be applied to the lock bar 420 to translate the lock bar 420 along a translation axis TA that is perpendicular to the rotational axis 36 such that one of the stop members 434 is disposed radially inward of the annular segments 146 and the other one of the stop members 434 is disposed radially outwardly of the annular segments 146. With a slight rotation of the first housing portion 30 relative to the second housing portion 32 about the rotational axis 36 the stop members 434 will at least partly overlie the annular segments 146 and as such, the force applied to the lock bar 420 may be released, which permits spring 452 of the biasing system 422 to urge the lock bar 420 in a direction away from, the single or sole one of the plate members 450 that is in contact with an associated one of the abutment surfaces 68 such that an exterior annular surface **434*e* of the stop member 434 that is located radially inward of the annular segments 146 to abut an interior annular surface 146*i* of one of the annular segments 146. When the first housing portion 30 is rotated relative to the second housing portion 32 to one of the first and second positions, the stop members 434 will be disposed in-line with the first and second recesses 132 and 134 and as such, the biasing force applied by the spring 452 will urge the lock bar 420 along the translation axis TA such that the stop members 434 are received in the first and second recesses 132 and 134 and interposed between the annular segments 146 to thereby inhibit further rotation of the first housing portion 30 relative to the second housing portion 32 about the rotational axis 36**.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A power tool comprising:

a first housing portion;

a battery mounted to the first housing portion;

a second housing portion that is rotatable relative to the first housing portion between a first position, in which the first and second housings are arranged in an in-line arrangement, and a second position in which the first and second housings are arranged in a pistol-grip arrangement;

a powertrain received in the second housing portion and having an output member, the output member extending from the second housing portion and being movable about an output member axis, the powertrain comprising an electric motor and a transmission;

a trigger coupled to the first housing portion and electrically coupled to the battery and the electric motor, the trigger being configured to control operation of the electric motor;

a mounting hub fixedly coupled to one of the first and second housing portions; and a lock bar slidably mounted to the other one of the first and second housing portions for movement in a direction that is transverse to a longitudinal axis of the other one of the first and second housing portions between a locked position and a first unlocked position, the lock bar cooperating with the mounting hub in the locked position to inhibit relative rotation between the first and second housing portions, and wherein placement of the lock bar in the first unlocked position permits relative rotation between the first and second housing portions;

wherein when the second housing portion is positioned in at least one of the first and second positions, the longitudinal axis of the other one of the first and second housing portions is coincident with the output member axis.

2. The power tool of claim 1, wherein the lock bar comprises a first locking tab that is engaged to the mounting hub when the lock bar is in the locked position.

3. The power tool of claim 2, wherein mounting hub comprises at least one annular segment and wherein the first locking tab is moved radially inwardly of the at least one annular segment when the lock bar is positioned in the first unlocked position.

4. The power tool of claim 3, wherein the lock bar comprises a second locking tab that is engaged to the mounting hub when the lock bar is in the locked position and which is disposed radially outwardly of the at least one annular segment when the lock bar is positioned in the first unlocked position.

5. The power tool of claim 4, wherein the lock bar is movable into a second unlocked position in which the first locking tab is disposed radially outwardly of the at least one annular segment and the second locking tab is disposed radially inwardly of the at least one annular segment.

6. The power tool of claim 1, wherein the lock bar is non-rotatably mounted to the other one of the first and second housing portions.

7. The power tool of claim 1, further comprising at least one spring that biases the lock bar into the locked position.

8. A power tool comprising:

a first housing portion;

a battery mounted to the first housing portion;

a second housing portion rotatable relative to the first housing portion such that the first housing portion can be selectively positioned relative to the second housing portion in an in-line orientation and in a pistol-grip orientation;

a powertrain having an output member, the output member extending from the second housing portion and being movable about an output member axis, the powertrain having a motor and a transmission that are housed entirely within the second housing portion;

a trigger mounted to the first housing portion and electrically coupled to the battery and the motor, the trigger being configured to control operation of the motor;

a mounting hub fixedly coupled to one of the first and second housing portions;

a bar body movably mounted to the other one of the first and second housing portions;

a pair of lock tabs fixedly coupled to one of the bar body and the mounting hub; and a pair of lock tab recess defined by the other one of the bar body and the mounting hub;

wherein the bar body is movable between a first position and a second position, wherein placement of the bar body in the first position locates the lock tabs in the lock tab recesses to inhibit relative rotation between the first and second housing portions, and wherein placement of the bar body in the second position locates the lock tabs out of alignment with the lock tab recesses to permit relative rotation between the first and second housing portions;

wherein when the first housing portion is positioned relative to the second housing portion in the in-line orientation, the bar body is transverse to the output member axis.

9. The power tool of claim 8, wherein the bar body is slidably mounted to the other one of the first and second housing portions.

10. The power tool of claim 9, wherein a lock bar aperture is formed through the other one of the first and second housing portions and wherein the bar body is movable through the lock bar aperture.

11. The power tool of claim 8, wherein the mounting hub comprises a pair of segments that define the lock tab recesses, each the segments having an annular surface.

12. The power tool of claim 11, further comprising at least one spring that biases the bar body into the first position, and wherein when the bar body is in the second position and the first and second housing portions are rotated relative to one another such that the bar body cannot be moved into the first position, a first one of the pair of lock tabs is biased into contact with the annular surface of one of the segments.

13. The power tool of claim 12, wherein the annular surfaces of the segments are radially inward surfaces.

14. The power tool of claim 8, further comprising at least one spring that biases the bar body into the first position.

15. The power tool of 14, wherein the bar body defines a pocket into which the at least one spring is received.

16. The power tool of claim 15, further comprising a plate member that is slidably mounted in the pocket of the bar body, wherein the other one of the first and second housing portions comprises a rib structure that defines an abutment surface, wherein plate member is disposed between the at least one spring and the abutment surface.

17. The power tool of claim 8, wherein the trigger is pivotally mounted to the first housing portion, wherein a first axis about which the trigger pivots is parallel to a second axis along which the bar body slides when the bar body is moved between the first and second positions.

18. The power tool of claim 17, further comprising a reversing switch housed by the other one of the first and second housing portions, wherein the reversing switch comprises a switch lever that is slidably mounted on to the other one of the first and second housing portions, and wherein the bar body is disposed between the trigger and the switch lever.

19. The power tool of claim 8, wherein the bar body is further movable into a third position in which the lock tabs are located out of alignment with the lock tab recesses to permit relative rotation between the first and second housing, and wherein the first position is disposed between the second and third positions.

20. A power tool comprising:

a first housing portion that defines a handle;

a battery received into the first housing portion;

a second housing portion;

a powertrain received in the second housing portion and having a motor, a transmission and an output member, the output member extending from the second housing portion and being rotatable about an output member axis;

a mounting hub fixedly coupled to the second housing portion, the mounting hub comprising a pair of annular segments that extend concentrically about a pivot axis, the annular segments cooperating to define a pair of lock recesses, the mounting hub being mounted on the first housing portion to pivotally couple the first housing portion to the second housing portion for rotation about the pivot axis; and a lock bar assembly comprising a lock bar and a spring, the lock bar having a bar body, which is slidably mounted to the first housing portion, a pair of lock tabs and a pocket into which the spring is received, the lock bar being movable between a first unlocked position, a locked position and a second unlocked position, wherein in each of the first and second unlocked positions the lock tabs are disposed radially between the annular segments to permit the annular segments to pass between the lock tabs, and wherein in the locked position the lock tabs are disposed in-line with the annular segments;

wherein the first housing portion is positionable relative to the second housing portion in an in-line orientation and a pistol-grip orientation, wherein when the first housing portion is positioned relative to the second housing portion in either of the in-line orientation and the pistol grip orientation, the lock bar is disposed transverse to the output member axis.

* * * * *

UNITED STATES PATENT AND TRADEMARK OFFICE

CERTIFICATE OF CORRECTION

PATENT NO. : 8,555,999 B2
APPLICATION NO. : 12/783850
DATED : October 15, 2013
INVENTOR(S) : Jason C. McRoberts et al.

It is certified that error appears in the above-identified patent and that said Letters Patent is hereby corrected as shown below:

In the Claims

Column 10, line 45 (Claim 11), after "each" insert -- of --.

line 57 (Claim 15), "of 14" should be -- of claim 14 --.

Signed and Sealed this
Twenty-eighth Day of January, 2014

Michelle K. Lee

Michelle K. Lee
*Deputy Director of the United States Patent and Trademark Office*